US010872541B1

(12) United States Patent
Awalt

(10) Patent No.: US 10,872,541 B1
(45) Date of Patent: Dec. 22, 2020

(54) BUMPER WITH INTEGRATED PRICE TAG HOLDER AND GRAPHICS HOLDER

(71) Applicant: Barry A. Awalt, Waterville, ME (US)

(72) Inventor: Barry A. Awalt, Waterville, ME (US)

( * ) Notice: Subject to any disclaimer, the term of this patent is extended or adjusted under 35 U.S.C. 154(b) by 0 days.

(21) Appl. No.: 16/520,110

(22) Filed: Jul. 23, 2019

(51) Int. Cl.
*G09F 3/20* (2006.01)
*A47B 96/20* (2006.01)

(52) U.S. Cl.
CPC ..... *G09F 3/204* (2013.01); *A47B 96/201* (2013.01); *A47B 2096/207* (2013.01)

(58) Field of Classification Search
CPC ..... A47B 96/201; A47B 2096/207; A47F 5/0068; A47F 5/0869; G09F 3/204
USPC ..... 40/661.03; 248/345.1
See application file for complete search history.

(56) References Cited

U.S. PATENT DOCUMENTS 5,242,734 A * 9/1993 Rubin ..... E04F 19/026 293/128
6,119,990 A * 9/2000 Kump ..... A47F 5/0068 211/57.1
6,158,702 A * 12/2000 Kump ..... B60R 13/005 211/86.01
6,568,112 B2 * 5/2003 Lowry ..... G09F 3/20 40/649
2005/0193612 A1 * 9/2005 Lowry ..... G09F 3/204 40/661.03
2006/0053670 A1 * 3/2006 Wiltfang ..... G09F 3/204 40/661.03
2014/0184037 A1 * 7/2014 Sidoti ..... A47B 13/083 312/140.4
2016/0029796 A1 * 2/2016 Schollmeyer ..... A47B 95/043 312/237
2017/0238724 A1 * 8/2017 Berglund ..... A47F 5/0838

* cited by examiner

*Primary Examiner* — Joanne Silbermann
(74) *Attorney, Agent, or Firm* — Anthony D. Pellegrini

(57) ABSTRACT

A bumper with integrated price tag holder and graphics holder configured to be affixed to a retail display fixture, retained in place by one or more fasteners, suitable for displaying price tags and product informational graphics.

23 Claims, 5 Drawing Sheets

BUMPER WITH INTEGRATED PRICE TAG HOLDER AND GRAPHICS HOLDER

BACKGROUND OF THE INVENTION

Product display fixtures are well known in the art. They are typically designed as a variant of a table or a cabinet, and are used to display goods in a retail setting. In the grocery industry, product display fixtures are used to display produce, dry goods, and other items. There is usually signage associated with product display fixtures, identifying the product being displayed as well as the price. Such signage may be placed on the display surface of the product display fixture, or affixed to a side of the product display fixture, or placed somewhere else. Finally, because a typical grocery store offers shopping carts to its customers as a convenience, product display fixtures typically have some form of a bumper affixed to their sides to protect against damage resulting from being struck by grocery carts.

However, the application of bumpers to a product display fixture is unwieldly and adds considerable expense. Most bumpers are designed as a multi-part system, comprising an attachment component that is physically affixed to a product display fixture, and a separate bumper component which attaches to the attachment component. The attachment is typically achieved by sliding the bumper component into a channel formed into the attachment component. Tolerances are tight and exact alignment is necessary to properly install such a bumper.

In addition, the placement of signage, as described above, is haphazard and arbitrary. Price tags may be placed on specialized price tag holders, which need to be installed on the fixtures. These may be made of wood or plastic. Signage describing the product needs to be placed on or near the fixtures. These may be made of metal, wood, or plastic. Having to separately purchase these items and then determine proper placement adds cost and inefficiencies.

It is therefore shown that there is a need for improved bumpers for product display fixtures which are simpler to install. It is also shown that there is a need for better controlling the placement of price tags and descriptive signage.

The present invention therefore discloses a bumper for a product display fixture having an integrated price tag holder and graphics holder. It provides protection of the fixture with the bumper, it allows a price point for the product by having an integrated price tag holder, and it allows retailers to eliminate many "signage programs" by providing a graphics holder that allows for easy placement of larger graphics that denote weekly specials or everyday graphics.

The present invention further reduces costs for both the manufacturer and the retailer.

SUMMARY OF THE INVENTION

The bumper with integrated price tag holder and graphics holder of the present invention is a one-piece, extruded length of rigid plastic that attaches directly to the side of a product display fixture. The front face of the bumper has an angled upper portion that receives a price tag and holds it securely in place. The front face of the bumper has a vertical lower portion that comprises one or more laterally disposed protuberances which absorb the impact of shopping carts. The bottom of the bumper comprises a lengthwise slot for receiving a graphics holder. The back face of the bumper aligns flush with the side of the product display fixture.

The bumper with integrated price tag holder and graphics holder of the present invention may be manufactured in any desired length, to fit standard sized product display fixtures, or it can be manufactured in a standard length and then cut down to the desired shorter length of a particular product display fixture. Installation is quick and easy because there is no need to properly align an attachment component so that a bumper component can slide over it. Attachment of the bumper with integrated price tag holder and graphics holder of the present invention can be accomplished by the use of fasteners passing through the bumper into the product display fixture. Alternatively, an adhesive may be applied to the back face of the bumper to affix it to the product display fixture.

Other features and advantages of the invention are described below.

DETAILED DESCRIPTION OF INVENTION

Figure 1:
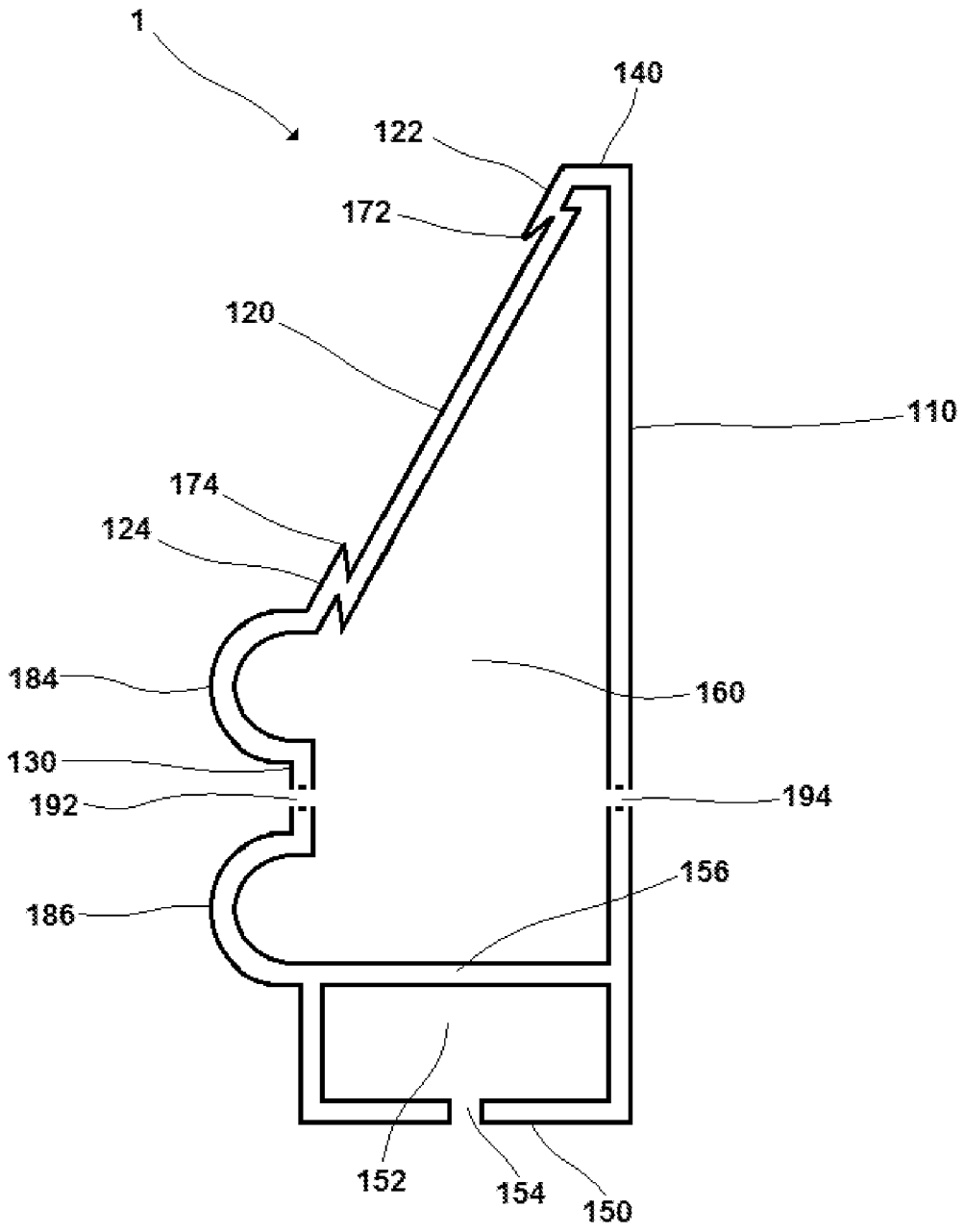
FIG. 1 is a side plan view of one embodiment of the present invention, depicting the bumper with integrated price tag holder and graphics holder.

In one embodiment of the present invention, a bumper 1 for use with a product display fixture 10 is disclosed. The bumper 1 is attached to the sides of the product display fixture 10 so that if the product display fixture 10 is struck by a shopping cart or other object damage to the product display fixture 10 is minimized. In the preferred embodiment, the bumper 1 comprises an elongate body 100. The body 100 has a back face 110, an upper front face 120, a lower front face 130, a top side 140, a bottom side 150, and a hollow interior 160 bounded by the back face 110, upper front face 120, lower front face 130, top side 140, and bottom side 150. See FIG. 1. The back face 110 of the body 100 is oriented substantially vertically. The upper front face 120 of the body 100 is oriented at an angle to the vertical, with the top portion 122 of the upper front face 120 of the body 100 located closer to the back face 110 of the body 100 than the lower portion 124 of the upper front face 120 of the body 100. The upper front face 120 of the body 100 is spaced apart from the back face 110 of the body 100. The lower front face 130 of the body 100 is oriented substantially vertically and is adjacent to the lower portion 124 of the upper front face 120 of the body 100. The lower front face 130 of the body 100 is spaced apart from the back face 110 of the body 100. The top side 140 of the body 100 is oriented substantially horizontally and joins the top portion 122 of the upper front face 120 of the body 100 to the back face 110 of the body 100. The bottom side 150 of the body 100 is oriented substantially horizontally and joins the lower front face 130 of the body 100 to the back face 110 of the body 100.

The upper front face 120 of the body 100 has a price tag holding component 170 integrated thereon. The lower front face 130 of the body 100 has a bumper component 180 integrated thereon. The body 100 may be made of any suitable material; preferably, it is made from Acrylonitrile Butadiene Styrene (ABS) plastic, though polypropylene or rubber could be used. The body 100 of the bumper 1 may be formed by extrusion. While the walls of the body 100 may have any suitable thickness, in the preferred embodiment it has a thickness of between $1/16^{nd}$ inch and $1/4^{th}$ inch, with the most preferred thickness being $1/8^{th}$ inch.

Figure 2:
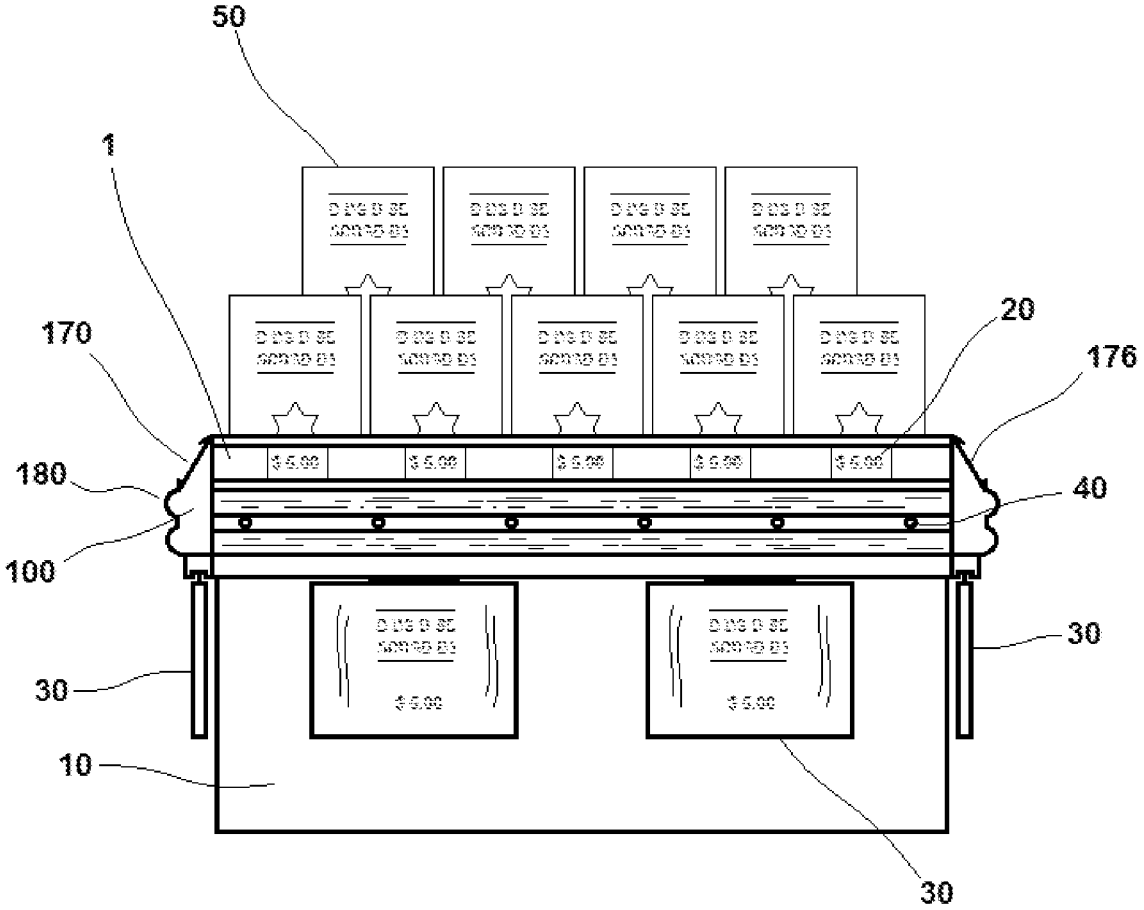
FIG. 2 is a front plan view of the embodiment of the present invention as attached to a product display fixture.

The price tag holding component 170 of the bumper 1 is configured to hold an elongate, planar price tag 20. The price tag holding component 170 comprises an upper lip 172 formed into the top portion 122 of the upper front face 120 of the body 100. The upper lip 172 extends forward and downward from the upper face 120 of the body 100. The price tag holding component 170 also comprises a lower lip 174 formed into the lower portion 124 of the upper front face 120 of the body 100. The lower lip 174 extends forward and upward from the upper front face 120 of the body 100. The upper lip 172 and the lower lip 174 for a channel 176 upon the upper face 120 of the body 100. The price tag 20 is inserted into the channel 176 and held in place by the upper lip 172 and lower lip 174, without the need for adhesives. See FIG. 2.

Figure 5:
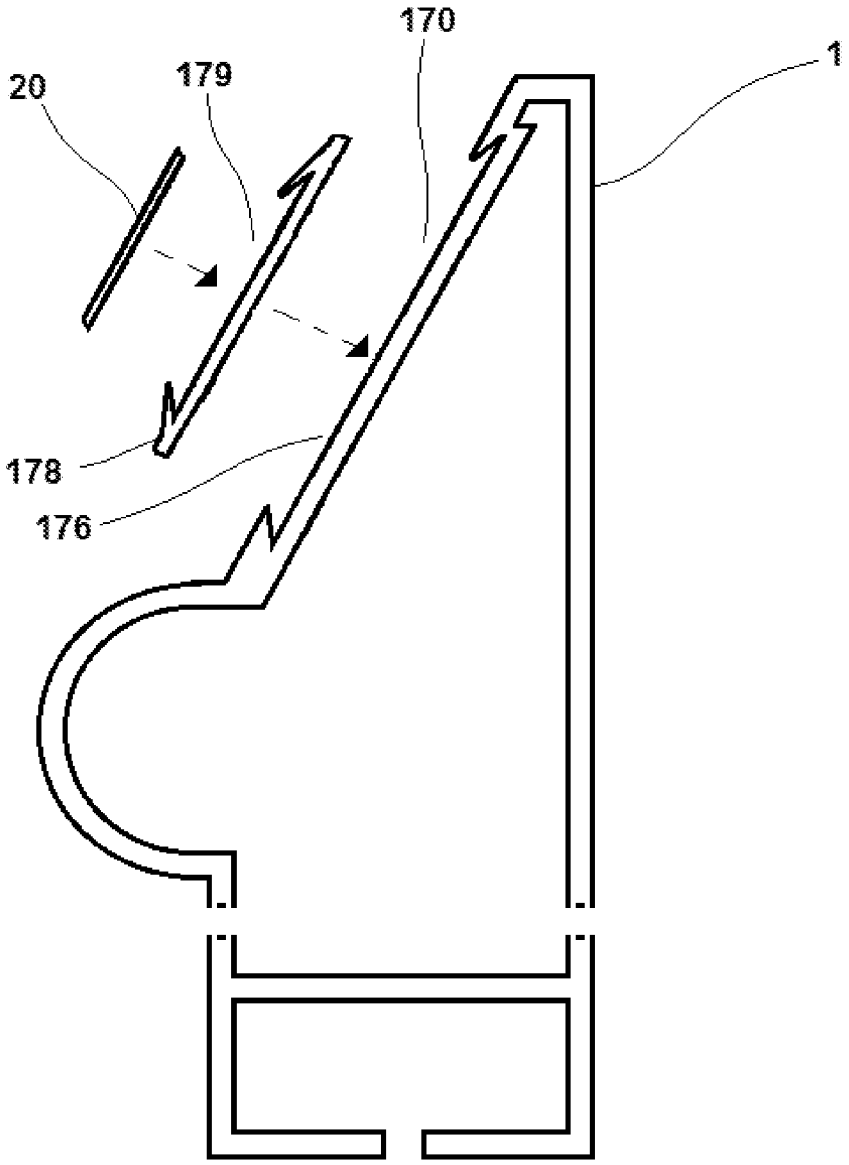
FIG. 5 is a side plan view of the embodiment of the present invention shown in FIG. 4, depicting an optional price tag support which is removably insertable into the integrated price tag holding component, onto which the price tag is placed.

In an optional variant of this embodiment, rather than inserting the price tag 20 directly into the channel 176 of the price tag holding component 170, an intermediate price tag support panel 178 is used. The price tag support panel 178 is configured to be inserted into the channel 176 of the price tag holding component 170. As such, the price tag support panel 178 may be a simple rectangular strip of ABS plastic. A price tag 20 may then be affixed to the price tag support panel 178, by the use of an adhesive. This variant allows the price tag support panel 178 to be removed from the bumper 1 for easy cleaning or replacement. In a preferred embodiment of this variant, the price tag support panel 178 itself has an upper lip and a lower lip, configured in the same manner as the upper lip 172 and the lower lip 174 of the price tag holding component 170, thereby forming a channel 179 on the price tag support panel; this allows a price tag 20 to be inserted into the channel 179 created by the upper lip and the lower lip of the price tag support panel 178 and held in place without the use of adhesives. See FIG. 5.

Figure 4:
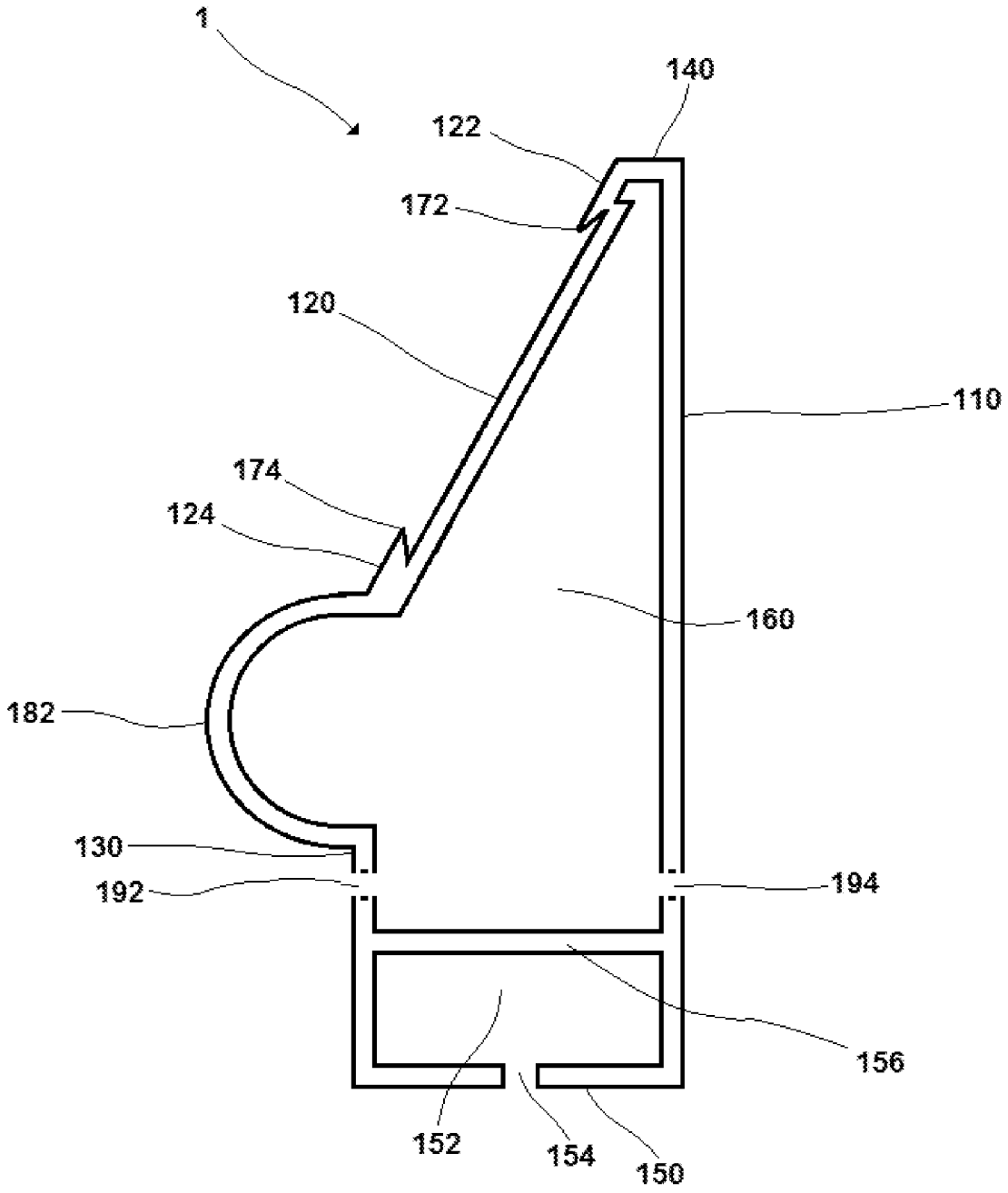
FIG. 4 is a side plan view of an alternate embodiment of the present invention, depicting a bumper component having a single protrusion.

In one embodiment of the present invention, the bumper component 180 of the bumper 1 comprises a protrusion 182 extending outward from the lower front face 130 of the body 100 in a direction away from the back face 110 of the body 100. See FIG. 4. This protrusion 182 may be hollow. The protrusion 182 may have a semicircular profile. The shape of the protrusion 182 is intended to provide a small amount of give, thereby cushioning any impact to the bumper 1.

In the preferred embodiment of the present invention, the bumper component 180 of the bumper 1 comprises a first protrusion 184 and a second protrusion 186. The first protrusion 184 extends outward from the lower front face 130 of the body 100 in a direction away from the back face 110 of the body 100. The second protrusion 186 extends outward from the lower front face 130 of the body 100 in a direction away from the back face 110 of the body 100. The second protrusion 186 is located below the first protrusion 184 and spaced apart therefrom. See FIG. 1. The first and second protrusions 184,186 may be hollow. The first and second protrusions 184,186 may each have a semicircular profile. In the most preferred embodiment the first protrusion 184 is sized and shaped substantially the same as the second protrusion 186.

Figure 3:
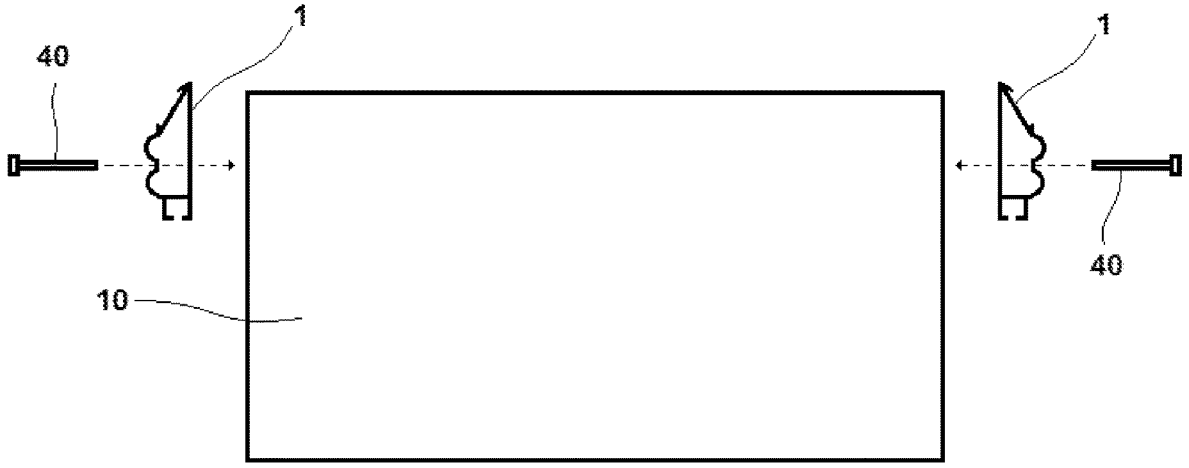
FIG. 3 is a front plan view of the embodiment of the present invention as depicted in FIG. 2, showing how the bumper is attached to the product display fixture with fasteners.

The body 100 of the bumper 1 further comprises a plurality of front apertures 192 formed into the lower front face 130 of the body 100, and a plurality of back apertures 194 formed into the back face 110 of the body 100. There are the same number of front apertures 192 as back apertures 194, and each front aperture 192 is aligned with a corresponding back aperture 194. This configuration of front and back apertures 192.194 allows an elongate fastener 40 to be passed through a pair of apertures 192,194. Each fastener 40 has a length greater than the depth of the body 100 of the bumper 1; when passed through a front aperture 192 and its corresponding back aperture 194 and into the product display fixture 10, the fastener 40 attaches the bumper 1 to the product display fixture 10. See FIG. 3. The fasteners 40 can be any suitable fastener known in the art, such as screws, bolts, pins, and the like.

In the embodiment where the bumper component 180 comprises just a single protrusion 182, each of the plurality of front apertures 192 may be located above the protrusion 182. Alternately, each of the plurality of front apertures 192 may be located below the protrusion 182. In yet another variation of this embodiment, half of the plurality of front apertures 192 may be located above the protrusion 182 and the remainder of the plurality of front apertures 192 may be located below the protrusion 182. Other arrangements of the front apertures 192 are also contemplated. In all such arrangements, there is a back aperture 194 aligned with each front aperture 192.

In the preferred embodiment where the bumper component 180 comprises a first protrusion 184 and a second protrusion 186, the plurality of front apertures 192 is located between the first protrusion 184 and the second protrusion 186. See FIG. 1.

In the most preferred embodiment of the present invention, the body 100 of the bumper 1 further comprises a bottom channel 152. The bottom channel 152 is formed by a channel wall 156 located within the hollow interior 160 of the body 100 and oriented substantially parallel to the bottom side 150 of the body 100. As such, the channel wall 156, the lower front face 130 of the body 100, the bottom side 150 of the body 100, and the back face 110 of the body 100 form the bottom channel 152. The bottom side 150 of the body 100 further has a channel aperture 154 formed therein. The channel aperture 154 extends the length of the body 100 and is oriented parallel to the back face 110 of the body 100. The channel aperture 154 extends through the bottom side 150 of the body 100, thereby allowing access into the bottom channel 152. The purpose of the bottom channel 152 is to provide a means for removably attaching a sign 30 or other graphic device to the bumper. Such signs 30 can be used to describe product 50 placed onto the product display fixture 10, or to advertise a sale, or for any other suitable purpose. See FIG. 2. Any such sign 30 will have an attachment component located long its top edge; this attachment component can be inserted into the bottom channel 152 through the channel aperture 154, and the bottom side 150 of the body 100 holds the sign 30 in place. In one variation the body 100 of the bumper 1 has open lateral sides; thus, the attachment component of the sign 30 can be slid into the bottom channel 152 through the open side. In this preferred embodiment of the present invention, then, the bumper 1 integrates the bumper component 180, the price tag holding component 170, and a graphic holding component in a single device.

The bumper 1 of the present invention may have any suitable width. In the preferred embodiment, the width of the body 100 of the bumper 1 is substantially the same as the length of a side of the product display fixture 10. In other embodiments it may be of a shorter width, necessitating the placement of several bumpers 1 along a single side of a product display fixture 10. End caps may be used to cover the adjacent ends of a pair of bumpers 1 coming together at adjacent sides of a product display fixture 10.

What has been described and illustrated herein are preferred embodiments of the bumper 1 of the present invention along with some it its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Other embodiments not specifically set forth herein are also contemplated.

I claim:

1. A bumper for use with a product display fixture, said bumper comprising an elongate, rigid body, said body having a back face, an upper front face, a lower front face, a top side, a bottom side, and a hollow interior bounded by the back face, upper front face, lower front face, top side, and bottom side, and further having a height, a depth, and a width;

wherein the back face of the body is oriented substantially vertically, the upper front face of the body is oriented at an angle to the vertical, with a top portion of the upper front face of the body located closer to the back face of the body than a lower portion of the upper front face of the body, with the upper front face of the body being spaced apart from the back face of the body, the lower front face of the body is oriented substantially vertically, is adjacent to the lower portion of the upper front face of the body, and is spaced apart from the back face of the body, the top side of the body is oriented substantially horizontally and is adjacent to the top portion of the upper front face of the body and is adjacent to the back face of the body, such that it joins the top portion of the upper front face of the body to the back face of the body, and the bottom side of the body is oriented substantially horizontally and is adjacent to the lower front face of the body and is adjacent to the back face of the body, such that it joins the lower front face of the body to the back face of the body;

with the upper front face of the body having a price tag holding component integrated thereon, and the lower front face of the body having a bumper component integrated thereon;

whereby said bumper is affixed to the product display fixture such that said bumper protects the product display fixture from damage from being struck by one or more shopping carts.

2. The bumper of claim 1 wherein the price tag holding component comprises an upper lip formed into the top portion of the upper front face of the body, extending forward and downward from the upper front face of the body, and a lower lip formed into the lower portion of the upper front face of the body, extending forward and upward from the upper front face of the body, such that a channel is formed upon the upper front face of the body, said channel being configured to allow an elongate, planar price tag to be inserted into the channel and further configured to hold said price tag in place therein by the upper lip and lower lip.

3. The bumper of claim 1 wherein the bumper component comprises a protrusion extending outward from the lower front face of the body in a direction away from the back face of the body.

4. The bumper of claim 3 wherein the protrusion is hollow.

5. The bumper of claim 3 wherein the protrusion has a semicircular profile.

6. The bumper of claim 3 further comprising a plurality of front apertures formed into the lower front face of the body, and a plurality of back apertures formed into the back face of the body, with there being the same number of front apertures as back apertures, and each such front aperture is positioned in alignment with a corresponding back aperture, such that the front apertures and back apertures are configured to allow an elongate fastener having a length greater than the depth of the body of the bumper to be passed through a front aperture and through the corresponding back aperture and into the product display fixture, thereby attaching the bumper to the product display fixture.

7. The bumper of claim 6 wherein each of the plurality of front apertures is located above the protrusion.

8. The bumper of claim 6 wherein each of the plurality of front apertures is located below the protrusion.

9. The bumper of claim 6 wherein half of the plurality of front apertures is located above the protrusion and the remainder of the plurality of front apertures is located below the protrusion.

10. The bumper of claim 1 wherein the bumper component comprises a first protrusion extending outward from the lower front face of the body in a direction away from the back face of the body, and a second protrusion extending outward from the lower front face of the body in a direction away from the back face of the body, with the second protrusion being located below the first protrusion and spaced apart therefrom.

11. The bumper of claim 10 wherein the first protrusion is sized and shaped substantially the same as the second protrusion.

12. The bumper of claim 10 wherein
the first protrusion is hollow, and
the second protrusion is hollow.

13. The bumper of claim 10 wherein
the first protrusion has a semicircular profile, and
the second protrusion has a semicircular profile.

14. The bumper of claim 10 further comprising
a plurality of front apertures formed into the lower front face of the body, and
a plurality of back apertures formed into the back face of the body,
with there being the same number of front apertures as back apertures, and each such front aperture is positioned in alignment with a corresponding back aperture,
such that the front apertures and back apertures are configured to allow an elongate fastener having a length greater than the depth of the body of the bumper to be passed through a front aperture and through the corresponding back aperture and into the product display fixture, thereby attaching the bumper to the product display fixture.

15. The bumper of claim 14 wherein the plurality of front apertures is located between the first protrusion and the second protrusion.

16. The bumper of claim 1 wherein
the body of the bumper further comprises a channel wall located within the hollow interior of the body and oriented substantially parallel to the bottom side of the body, such that the channel wall, the lower front face of the body, the bottom side of the body, and the back face of the body form a bottom channel; and
the bottom side of the body has a channel aperture formed therein, said channel aperture extending the length of the body and oriented parallel to the back face of the body, said channel aperture extending through the bottom side of the body thereby allowing access into the bottom channel.

17. The bumper of claim 1 wherein the body of the bumper has open lateral sides.

18. The bumper of claim 1 wherein the width of the body of the bumper is substantially the same as a length of a side of the product display fixture.

19. The bumper of claim 1 wherein the body of the bumper is constructed of a plastic material.

20. The bumper of claim 19 wherein the body of the bumper is extruded.

21. The bumper of claim 1 further comprising
a price tag support panel, said price tag support panel being elongate and configured to retain a price tag thereon;
wherein the price tag holding component comprises
an upper lip formed into the top portion of the upper front face of the body, extending forward and downward from the upper front face of the body, and
a lower lip formed into the lower portion of the upper front face of the body, extending forward and upward from the upper front face of the body,
such that a channel is formed upon the upper front face of the body, said channel being configured to allow the insertion of the price tag support panel into said channel and further configured to hold said price tag support panel in place therein by said upper lip and said lower lip.

22. The bumper of claim 21 wherein the price tag support panel is substantially planar and substantially rectangular in shape.

23. The bumper of claim 1 further comprising a price tag support panel, said price tag support panel being substantially rectangular in shape and having a front face and a back face, and configured to retain a price tag thereon;
wherein the price tag holding component comprises
an upper lip formed into an upper portion of the front face of the price tag support panel, said upper lip of the price tag support panel extending forward and downward from the front face of the price tag support panel, and
a lower lip formed into a lower portion of the front face of the price tag support panel, said lower lip of the price tag support panel extending forward and upward from the front face of the price tag support panel,
such that a channel is formed upon the front face of the price tag support panel, said channel of the price tag support panel being configured to allow the insertion of an elongate, planar price tag into said channel of the price tag support panel and further configured to hold said price tag in place therein by said upper lip of the price tag support panel and said lower lip of the price tag support panel.

* * * * *